US005264659A

United States Patent [19]

Kunimoto

[11] Patent Number: 5,264,659

[45] Date of Patent: Nov. 23, 1993

[54] MUSICAL TONE SYNTHESIZING APPARATUS HAVING CONTROLLABLE FEEDBACK

[75] Inventor: Toshifumi Kunimoto, Hamamatsu, Japan

[73] Assignee: Yamaha Corporation, Hamamatsu, Japan

[21] Appl. No.: 872,093

[22] Filed: Apr. 22, 1992

[30] Foreign Application Priority Data

Apr. 26, 1991 [JP] Japan ..... 3-097759

[51] Int. Cl.[5] ..... G10H 1/12

[52] U.S. Cl. ..... 84/661; 84/DIG. 9; 84/DIG. 10

[58] Field of Search ..... 84/622-625, 84/661, 699, 700, 723, 736, DIG. 9, DIG. 10

[56] References Cited

U.S. PATENT DOCUMENTS 4,984,276 1/1991 Smith .
5,113,743 5/1992 Higashi ..... 84/622
5,117,730 6/1992 Yamauchi ..... 84/723

FOREIGN PATENT DOCUMENTS 63-40199 2/1988 Japan .
3-59599 3/1991 Japan .

*Primary Examiner*—Stanley J. Witkowski
*Attorney, Agent, or Firm*—Graham & James

[57] ABSTRACT

A musical tone synthesizing apparatus is designed to simulate sounds of the non-electronic musical instrument, particularly the wind instrument. Herein, a wave-guide network and an excitation-vibration portion are connected together in a closed-loop. The wave-guide network is configured by plural bi-directional transmission circuits each at least providing a delay element, while the excitation-vibration portion provides a feedback loop between its input/output terminals. The feedback rate of this feedback loop is adjusted by a control signal supplied from an external device. By merely varying this control signal, it is possible to change the resonance frequency and also vary the width of the hysteresis curve representing the input/output characteristics of the excitation-vibration portion. When simulating the sounds of the wind instrument, the control signal corresponds to the blowing pressure applied to the mouthpiece of the wind instrument.

4 Claims, 1 Drawing Sheet

MUSICAL TONE SYNTHESIZING APPARATUS HAVING CONTROLLABLE FEEDBACK

BACKGROUND OF THE INVENTION

1. Field of the Invention

The present invention relates to a musical tone synthesizing apparatus which is suitable for synthesizing sounds of non-electronic musical instruments.

2. Prior Art

There is the known musical tone synthesizing apparatus which activates a simulation model, simulating the tone- generation mechanism of the non-electronic musical instrument, so as to synthesize musical tones. As for the wind instrument, operation of the resonance tune is simulated by the combination of the delay circuit and filter, wherein the delay circuit corresponds to the propagation delay of the air-pressure wave in the tube, while the filter corresponds to the acoustic loss in the tube. The reed portion, i.e., vibrating element of the wind instrument, is simulated by a non-linear circuit having a non-linear input/output characteristic corresponding to the elastic characteristic of the reed. By connecting the delay circuit, filter, non-linear circuit, etc. in the closed-loop, it is possible to configure the musical tone synthesizing apparatus which synthesizes the sounds of the wind instrument.

In some cases, the musical parameters of the wind instrument such as the pitch and tone color may be varied in response to the breath pressure which is applied to the wind instrument to be performed. However, there is no musical tone synthesizing apparatus which can simulate such variations of the musical parameters.

SUMMARY OF THE INVENTION

It is accordingly a primary object of the present invention to provide a musical tone synthesizing apparatus which can vary the musical parameters of the musical tones in response to the control signal applied from the external device and the like.

In an aspect of the present invention, there is provided a musical tone synthesizing apparatus comprising:

a delay means which at least effects a delay operation on an input signal thereof;

an excitation-vibration means, coupled with a feedback loop between its input/output terminals, which performs the predetermined non-linear operation on the basis of a control signal, supplied from an external device, and an output signal of the delay means, so that the operation result thereof is supplied to the delay means as the foregoing input signal; and an adjusting means which adjusts a feedback rate of the feedback loop in the excitation-vibration means in response to the foregoing control signal.

Herein, the above-mentioned excitation-vibration means and delay means are connected together in a loop circuit means which synthesizes a musical tone signal to be generated.

According to the above-mentioned configuration, the feedback rate of the feedback loop in the excitation-vibration means is adjusted in response to the control signal, thus, it is possible to adjust the phase delay of the signal passing through the excitation-vibration means and also adjust the distortion of the output signal of the excitation-vibration means. As a result, it is possible to adjust the musical parameters such as the pitch and tone color of the musical tones to be synthesized in response to the control signal.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENT

Figure 1:
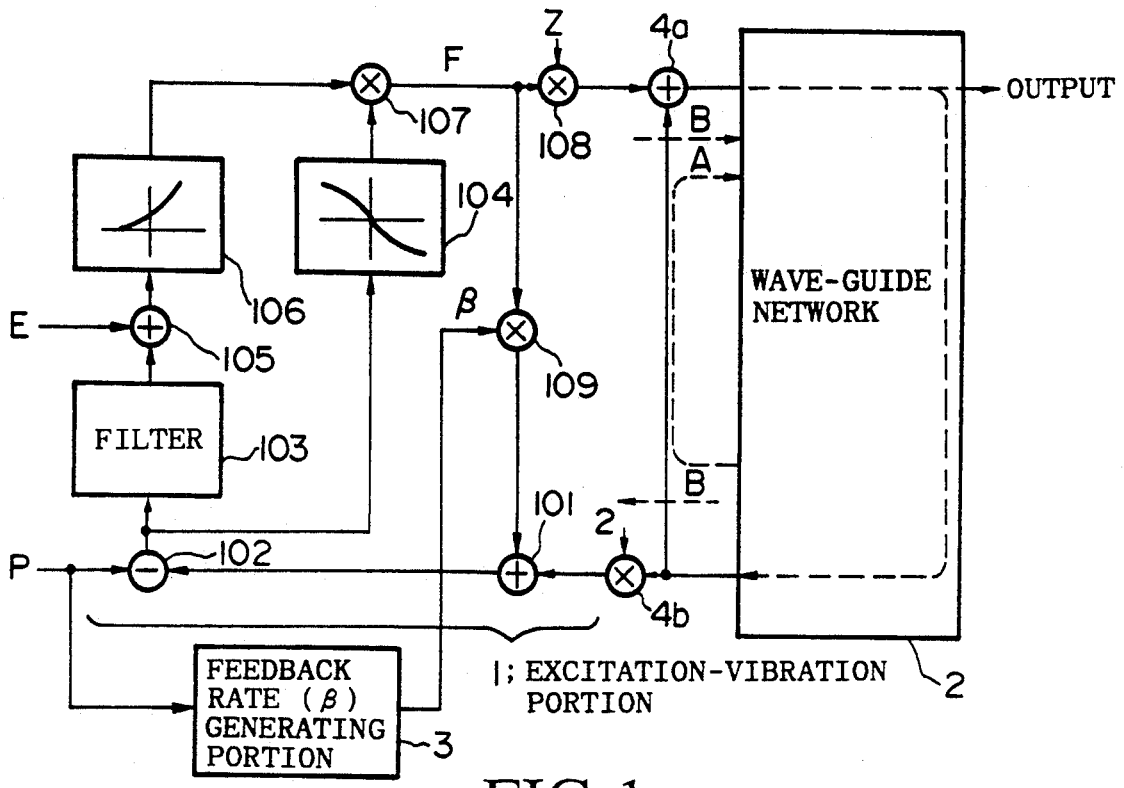
FIG. 1 is a block diagram showing an electric configuration of a musical tone synthesizing apparatus according to an embodiment of the present invention.

Next, description will be given with respect to an embodiment of the present invention by referring to the drawings.

FIG. 1 is a block diagram showing an electric configuration of a musical tone synthesizing apparatus according to an embodiment of the present invention. In FIG. 1, 1 designates an excitation-vibration portion which simulates the operation of the mouthpiece of the wind instrument, while 2 designates a wave-guide network which simulates the operation of the resonance tube of the wind instrument. This wave-guide network 2 is configured by connecting plural wave-guides (i.e., bi-directional transmission circuits), signal scattering junctions, low-pass filters and the like (not shown) in cascade connection manner. Herein, each of the wave-guides has a delay circuit at its one transmission path at least; each of the signal scattering junctions is provided to connect two wave-guides together; and the low-pass filter is designed to simulate the acoustic loss to be occurred in the resonance tube of the wind instrument. The signal outputted from the excitation-vibration portion 1 passes through the above-mentioned circuit elements of the wave-guide network 2, and then it is fed back to the excitation-vibration portion 1 again. Incidentally, such kind of wave-guide network 2 is disclosed in Japanese Patent Laid-Open Publication No. 63-40199, for example. Meanwhile, an adder 4*a* and a multiplier 4*b* configure a junction corresponding to the connecting portion between the mouthpiece and resonance tube of the wind instrument. This junction performs the bi-direction signal transmission between the excitation-vibration portion 1 and wave-guide network 2. More specifically, the output of the excitation-vibration portion 1 is supplied to the first input of the adder 4*a*, and the output of the adder 4*a* is supplied to the wave-guide network 2. On the other hand, the output of the wave-guide network 2 is supplied to the second input of the adder 4*a*, and this output is also supplied to the multiplier 4*b* wherein it is doubled and then supplied to the excitation-vibration portion 1.

Next, detailed description will be given with respect to the configuration of the excitation-vibration portion 1.

The input signal of the excitation-vibration portion 1 corresponds to the pressure of the air-vibrating-wave which is fed back to the reed in the mouthpiece of the wind instrument. This input signal is supplied to a first input of an adder 101, of which output is supplied to a subtracter 102. In the subtracter 102, a signal value P corresponding to the blowing pressure of the wind instrument is subtracted from the output value of the adder 101. Thus, the output of the subtracter 102 corresponds to the internal pressure of the mouthpiece. The output signal of the subtracter 102 is delivered to a filter 103 (which is normally configured as the low-pass filter) and a non-linear circuit 104 respectively. Herein, the filter 103 simulates the response characteristic of the reed corresponding to the variation of the internal pressure of the mouthpiece, while the non-linear circuit 104 simulates the saturation characteristic of the air-flow velocity with respect to the internal air-pressure in the mouthpiece. When embodying this musical tone synthesizing apparatus by use of the digital circuitry, each of the non-linear circuits 104, 106 can be constructed by the read-only memory (i.e., ROM) memorizing the non-linear table, for example. The output of the filter 103 is supplied to an adder 105 wherein it is added with an Embouchure signal E which corresponds to the pressure of holding the mouthpiece in the performer's mouth. Thus, the adder 105 outputs the signal which corresponds to the pressure applied to the reed. This output signal of the adder 105 is supplied to the non-linear circuit 106 which simulates the variation of the sectional area of the gap formed between the reed and mouthpiece with respect to the pressure variation of the reed. The output signal of the non-linear circuit 106 is multiplied by the output signal of the non-linear circuit 104 in a multiplier 107. Thus, the multiplier 107 outputs a signal F corresponding to the velocity of the air-flow which passes through the gap between the mouthpiece and reed. This output signal F of the multiplier 107 is delivered to both of multipliers 108, 109. In the multiplier 109, the signal F is multiplied by a feedback rate $\beta$, and then the multiplication result is fed back to the second input of the adder 101. Herein, the feedback rate $\beta$ is supplied from a feedback rate generating portion 3 in response to the foregoing value P. In the multiplier 108, the signal F is multiplied by a value Z corresponding to the impedance applied to the air-flow in the mouthpiece. Thus, the multiplier 108 outputs the signal which corresponds to the variation of the internal pressure of the mouthpiece, and this output signal of the multiplier 108 is supplied to the foregoing wave-guide network 2 via the adder 4*a*.

Next, description will be given with respect to the operation of the present embodiment.

Figure 2:
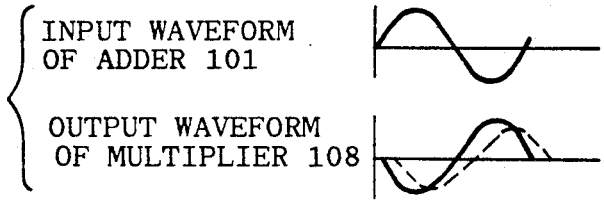
FIG. 2 shows waveforms representing the input/output characteristics of a main part of the embodiment shown in FIG. 1.

According to the present embodiment, the signal circulation is carried out between the excitation-vibration portion 1 and wave-guide network 2, so that the circulating signal is picked up as the musical tone signal. In the excitation-vibration portion 1, the non-linear amplifying operation is carried out by the non-linear circuits 104, 106, and the negative feedback operation is also carried out by use of the feedback rate $\beta$. Thus, the hysteresis characteristic is imparted to the input/output characteristics of the excitation-vibration portion 1, representing the output variation of the multiplier 108 with respect to the input variation of the adder 101. Herein, as the width of hysteresis curve becomes larger, the feedback rate $\beta$ becomes larger. FIG. 2 illustrates the input waveform of the adder 101 and output waveform of the multiplier 108. When the feedback rate $\beta$ is relatively small, the output of the multiplier 108 is varied along with the full-line curve. In this case, the delay time of the output signal of the excitation-vibration portion 1 is relatively small, and the distortion of the output of the multiplier 108 is also relatively small. On the other hand, when the value P becomes larger so that the feedback rate $\beta$ becomes larger, the output of the multiplier 108 is varied along with the dotted-line curve, therefore, the delay time is relatively large and the output distortion is also relatively large.

Figure 3:
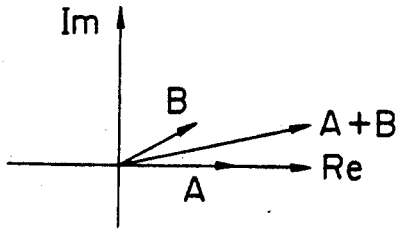
FIG. 3 is a drawing showing the composition of vectors representing the phase relationship between signals in the circuit shown in FIG. 1.

Meanwhile, the resonance frequency of this musical tone synthesizing apparatus can be computed as the inverse value of the period of the signal which circulates through the excitation-vibration portion 1 and wave-guide network 2. If the excitation-vibration portion 1 is omitted from the circuit configuration, the signal circulation is made through path "A" only. In this case, the resonance frequency depends on the delay time of the wave-guide network 2 only. Herein, the signal passing through the wave-guide network 2 can be represented by the sum of the signals respectively passing through paths A, B, wherein path B contains the excitation-vibration portion 1, while path A does not contain it. Therefore, as shown in FIG. 3 (illustrating the composition of vectors), the phase of the signal passing through the path B is delayed behind the phase of the signal passing through the path A. Due to the phase delay concerning the path B, "A+B" in FIG. 3 representing the phase of the sum of the signals respectively passing through the paths A, B must be delayed, which functions to reduce the resonance frequency. As such reduction of the resonance frequency becomes greater, the value P becomes greater, or the width of the hysteresis curve of the input/output characteristics of the excitation-vibration portion 1 becomes greater.

As described heretofore, by varying the value P corresponding to the blowing pressure, it is possible to change the resonance frequency and it is also possible to vary the waveform of the signal supplied to the wave-guide network 2. Thus, it is possible to vary the pitch and tone color of the musical tone to be generated. In addition, the present embodiment can prevent the anomalous oscillation of the feedback loop from occurring. In general, the circuit containing the feedback loop may suffer from the risk in that anomalous oscillations will occur. Particularly, in case of the circuit as shown in FIG. 1, when the value P is relatively low, there is a risk that such oscillations will occur. However, the present embodiment can prevent such anomalous oscillation from occurring by controlling the feedback rate $\beta$ in the relatively low level as long as the value P is relatively low.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus comprising:

a wave-guide network for transmitting an input signal, said wave-guide network having delay means for delaying a signal input thereto;

excitation means for performing a predetermined non-linear operation on the basis of an output signal of said wave-guide network and a control signal provided from an external device so that an operation result thereof is supplied to said wave-guide network as said input signal, wherein said excitation means and said wave-guide network are connected together in a loop which synthesizes a musical tone signal to be generated;

feedback means, coupled between input/output portions of said excitation means, for feeding an output signal of said excitation means back to said input portion at a feedback rate; and feedback control means for controlling said feedback rate in response to said control signal.

2. A musical tone synthesizing apparatus as defined in claim 1 wherein said control signal corresponds to blowing pressure applied by a performer so that said feedback rate is adjusted in response to the blowing pressure, whereby said musical tone signal to be picked up from said loop simulates sounds of a wind instrument to be played by the performer.

3. A musical tone synthesizing apparatus is defined in claim 1 wherein said wave-guide network includes a plurality of bi-directional transmission circuits each at least providing a delay element.

4. A musical tone synthesizing apparatus as defined in claim 1 wherein said feedback control means includes feedback rate generating means for generating a feedback rate responsive to said control signal, and said feedback means includes a multiplier, wherein a feedback signal passing through said feedback means is multiplied by said feedback rate in said multiplier.

* * * * *